US009837231B2

(12) United States Patent
Higashikata et al.

(10) Patent No.: US 9,837,231 B2
(45) Date of Patent: Dec. 5, 2017

(54) THERMAL SWITCH, METHOD OF MANUFACTURING THE SAME AND DEVICE FOR ADJUSTING HEIGHT OF MOVABLE CONTACT

(71) Applicant: UBUKATA INDUSTRIES CO., LTD., Nagoya-shi, Aichi (JP)

(72) Inventors: Isao Higashikata, Nagoya (JP); Yuji Adachi, Nagoya (JP)

(73) Assignee: UBUKATA INDUSTRIES CO., LTD., Nagoya-Shi, Aichi (JP)

( * ) Notice: Subject to any disclaimer, the term of this patent is extended or adjusted under 35 U.S.C. 154(b) by 0 days.

(21) Appl. No.: 14/761,425

(22) PCT Filed: Jan. 21, 2013

(86) PCT No.: PCT/JP2013/051076
§ 371 (c)(1),
(2) Date: Jul. 16, 2015

(87) PCT Pub. No.: WO2014/112121
PCT Pub. Date: Jul. 24, 2014

(65) Prior Publication Data

US 2015/0364282 A1 Dec. 17, 2015

(51) Int. Cl.
*H01H 37/52* (2006.01)
*H01H 11/00* (2006.01)
(Continued)

(52) U.S. Cl.
CPC ..... *H01H 37/52* (2013.01); *H01H 11/00* (2013.01); *H01H 37/04* (2013.01); *H01H 37/12* (2013.01);
(Continued)

(58) Field of Classification Search
CPC ..... H01H 37/54; H01H 11/00; H01H 37/52; H01H 37/12; H01H 37/20; H01H 37/04;
(Continued)

(56) References Cited

U.S. PATENT DOCUMENTS 4,860,435 A * 8/1989 Powell ..... H01H 37/12 29/622
5,015,985 A * 5/1991 Ubukata ..... H01H 37/12 337/107
(Continued)

FOREIGN PATENT DOCUMENTS

JP H01122534 5/1989
JP 2519530 B2 9/1990
(Continued)

OTHER PUBLICATIONS

International Search Report dated Feb. 12, 2013, for International Patent Application No. PCT/JP2013/051076.
(Continued)

*Primary Examiner* — Anatoly Vortman
(74) *Attorney, Agent, or Firm* — Karceski IP Law, PLLC

(57) ABSTRACT

A thermal switch includes a thermally responsive plate assembly including a metal support deforming from an initial shape before a header plate assembly is secured to a housing assembly, with a result that a position of a movable contact in the housing assembly is adjusted so as to be within a predetermined height range relative to an open end of a housing. A contact pressure of switching contacts after the assembling is produced by the height adjustment, and subsequently, a neighborhood of a part of the housing to which part the thermally responsive plate assembly is secured is deformed, so that an operating temperature is calibratable.

11 Claims, 9 Drawing Sheets

(51) Int. Cl.

| | |
|---|---|
| ***H01H 37/04*** | (2006.01) |
| ***H01H 37/54*** | (2006.01) |
| ***H01H 37/12*** | (2006.01) |
| ***H01H 37/20*** | (2006.01) |
| *H01H 37/26* | (2006.01) |

(52) U.S. Cl.
CPC ..... *H01H 37/20* (2013.01); *H01H 37/54* (2013.01); *H01H 37/26* (2013.01); *H01H 37/5418* (2013.01); *H01H 37/5427* (2013.01); *H01H 2011/0075* (2013.01); *H01H 2223/008* (2013.01); *Y10T 29/49107* (2015.01)

(58) Field of Classification Search
CPC ..... H01H 37/5418; H01H 37/5427; H01H 37/26; H01H 2011/0075; H01H 2223/008; Y10T 29/49107
USPC ..... 337/380
See application file for complete search history.

(56) References Cited

U.S. PATENT DOCUMENTS 5,196,820 A * 3/1993 Ubukata ..... H01H 37/5418 337/3
5,212,465 A * 5/1993 Mizutani ..... H01H 37/5418 337/347
5,221,914 A * 6/1993 Ubukata ..... H01H 37/002 337/13
7,075,403 B2 * 7/2006 Unno ..... F04C 23/008 337/343
8,717,140 B2 * 5/2014 Hori ..... H01H 1/02376 337/298
8,902,037 B2 * 12/2014 Ueda ..... H01H 1/02372 337/298
2004/0100351 A1 * 5/2004 Unno ..... F04C 23/008 337/100
2009/0302989 A1 * 12/2009 Ueda ..... H01H 1/02372 337/298
2010/0315193 A1 * 12/2010 Hori ..... H01H 1/02376 337/326

FOREIGN PATENT DOCUMENTS

| | | | |
|---|---|---|---|
| JP | H02227928 | A | 9/1990 |
| JP | H0536335 | A | 2/1993 |
| JP | H06295651 | A | 10/1994 |
| JP | H10144189 | A | 5/1998 |
| KR | 10-1990-0015205 | | 10/1990 |

OTHER PUBLICATIONS

Notification of Submission of Argument dated Oct. 20, 2016, for Korean Patent Application No. 10-2015-7018375.
Extended European Search Report dated Sep. 8, 2016 for European Patent Application No. 13871432.4.
Korean Office Action dated Apr. 20, 2017, for Korean Patent Application No. 10-2015-7018375.

* cited by examiner

THERMAL SWITCH, METHOD OF MANUFACTURING THE SAME AND DEVICE FOR ADJUSTING HEIGHT OF MOVABLE CONTACT

CROSS-REFERENCE TO RELATED APPLICATIONS

This Non-Provisional patent application is National Stage Entry into the United States Patent and Trademark Office from International Patent Application No. PCT/JP2013/051076, having an international filing date of Jan. 21, 2013, the entire contents of which are incorporated herein by reference.

FIELD OF THE INVENTION

The present invention relates to a thermal switch having a contact switching mechanism using a thermally responsive plate such as a bimetal in a pressure-proof hermetic container including a metal housing and a header plate, a method of manufacturing the same and a device for adjusting a height of a movable contact.

DESCRIPTION OF RELATED ART

Thermal switches of the above-mentioned type are disclosed in Japanese Patent No. JP-B-2519530, Japanese Patent No. JP-B-2860517, and the like. The thermal switch described in each document comprises a thermally responsive plate assembly including a thermally responsive plate, a movable contact and a metal support all housed in a closed container including a metal housing and a header plate. The movable contact is secured to one of two ends of the thermally responsive plate, and the metal support is secured to the other end of the thermally responsive plate. The thermally responsive plate reverses a direction of curvature thereof at a predetermined temperature. An electrically conductive terminal pin is inserted through a through hole of the header plate and hermetically fixed in the hole by an electrically insulating filler such as glass. A fixed contact constituting switching contacts together with the movable contact is attached to a distal end of the terminal pin located in the closed container.

The thermal switch is mounted in a closed housing of a hermetic electric compressor thereby to be used as a thermal protector for an electric motor of the compressor. In this case, windings of the motor are connected to the terminal pin or the header plate. The thermally responsive plate reverses the direction of curvature when a temperature around the thermally responsive switch becomes unusually high or when an abnormal current flows in the motor. When the temperature drops to or below a predetermined value, the contacts are re-closed such that the compressor motor is energized. A temperature at which the thermally responsive plate reverses the direction of curvature thereof is configured to be calibrated by crushing a secured part (a calibration part) of the metal support to the closed housing from the outside (hereinafter, "crushing temperature adjustment").

Japanese Patent No. 2860517 discloses a thermal switch having a construction similar to the above-described thermal switch. In this thermal switch, the conductive terminal pin has a distal end located in the closed housing. A metal fixed contact support has one end secured to the distal end of the conductive terminal pin and the other end to which the fixed contact is secured. The fixed contact has a height above a back surface or a front surface of the fixed contact support.

The height of the fixed contact is adjusted to a predetermined value. The fixed contact has a contact surface with the movable contact, which contact surface is formed into a predetermined shape. This can reduce variations in a contact height caused in the welding of the fixed contact to the fixed contact support and variations in a contact pressure after the assembly, thereby rendering a temperature calibrating work after the assembly easier.

Japanese Patent Application Publication No. H05-36335 discloses a thermal switch including a fixed contact secured to a header plate and an electrical conductor fixed through the header plate and having a distal end located in a closed housing. A thermally responsive plate support has one end secured to the distal end of the conductor. The thermally responsive plate support is provided with a supporting portion to which one end of a thermally responsive plate is secured. A movable contact is secured to the other end of the thermally responsive plate. A calibrating piece made of an electrically insulating material is inserted near the other end of the thermally responsive plate support.

SUMMARY OF THE INVENTION

In the thermal switches described in the above-referenced patent documents, there is also a problem of variations in the shape of the thermally responsive switch and in the secured position of the thermally responsive plate as well as variations in the height of the fixed contact. The thermally responsive plate used in the thermal switches is made of a bimetal, for example and has a part located near the center thereof and drawn into a dish shape. In this construction, variations in the characteristics of the bimetal, processing variations caused by the drawing or the like result in variations in a curved shape of the thermally responsive plate after the drawing.

Further, in the process of forming a thermally responsive plate assembly using the thermally responsive plate and securing the assembly to the housing or the conductor, variations in shape, finished dimensions and the like occur in a welded part between the thermally responsive plate and the metal support, a welded part between the thermally responsive plate and the movable contact, a welded part between the metal support and the housing or the conductor. When there are variations in the shape or dimensions, variations also occur in an initial contact pressure between the contacts after the assembly. With this, variations also occur in an amount of deformation (an amount of crush) of the calibration portion during the above-mentioned temperature calibration.

In the thermal switch described in Japanese Patent Application Publication No. H05-36335, the supporting portion of the thermally responsive plate support includes a root portion. The root portion is deformed so that the movable and fixed contacts are located so as to be in slight contact with each other or opposed to each other with a slight gap therebetween before a cover is welded to the header plate. According to this adjustment, the position adjustment is allowed before assembly except for the contact between the movable and fixed contacts. However, further positional adjustment is disallowed when the movable and fixed contacts have been brought into contact with each other, with the result that an initial contact pressure cannot be imparted to the movable and fixed contacts, and variations in the contact pressure cannot be adjusted. This excessively increases an amount of crush in the temperature adjustment by the crushing or results in variations in the amount of crush.

FIG. 9 explains variations in the amount of crush in Japanese Patent No. 2519530 and Japanese Patent Application Publication No. H10-144189. Time t1 refers to the time when the thermally responsive plate assembly is mounted to the housing, and the vertical axis denotes a height H of the movable contact above an open end of the housing. The height of the movable contact has a variation of ΔH (0.5 mm, for example) by the foregoing cause. Time t2 refers to the time when the header plate is secured to the housing and the temperature adjustment by the crushing is carried out, and the vertical axis denotes a crush amount C with reference to a height position at time t1.

Since a position (HA) of the movable contact above the open end of the housing at the time of the mounting of the thermally responsive plate assembly is excessively high in product A, the movable contact is spaced away from the fixed contact at the time of assembly. The calibrating part is then crushed such that the movable contact is brought into contact with the fixed contact, with the result that the product A is calibrated to a specified operating temperature. An amount of crush in this case is referred to as "CA." On the other hand, since a position (HB) of the movable contact above the open end of the housing at the time of the mounting of the thermally responsive plate assembly is excessively low in product B, the movable contact is already in contact with the fixed contact at the time of assembly. The calibrating part is then crushed such that the product B is calibrated to a specified operating temperature. An amount of crush in this case is referred to as "CB." A variations ΔC in the amount of crush is substantially equal to a variation ΔH in the height of the movable contact except for a variation in the contact pressure required to obtain a specified operating temperature.

When an amount of deformation in the calibrating part becomes excessively large as in the above-mentioned product A, there is the possibility of a defect that the metal support secured near the calibrating part would come off, a defect that stress would be concentrated on a neighborhood of the calibrating part with the result of reduction in the strength and durability of the closed container, or the like defect. Further, when the contact pressure before temperature calibration during the assembly has already exceeded a value corresponding to a reversing temperature, the temperature calibration by the crushing cannot be carried out. Still further, in a thermal switch of the type that a heater is provided in the closed container, a distance between the thermally responsive switch and the heater differs depending upon an amount of deformation of the calibrating part. Accordingly, a short time trip (S/T or ST operating time) varies as a variation ΔC in the amount of crush becomes large. The short time trip refers to a time period required until the opening of the contacts in a case where an excessively large current flows such as a case where a rotor of the motor is locked.

The present invention was made in view of the foregoing circumstances and an object thereof is to provide a thermal switch in which an amount of deformation of the calibrating part to calibrate the operating temperature can be rendered substantially constant and a stable protecting performance can be achieved, and a method of manufacturing the thermal switch and a device for adjusting a height of the movable contact.

A thermal switch according to one embodiment includes a housing assembly and a header plate. The housing assembly includes a metal housing having an open bottom and a thermally responsive plate assembly housed in the metal housing and including a thermally responsive plate, a movable contact secured to one of two ends of the thermally responsive plate, and a metal support secured to the other end of the thermally responsive plate. The thermally responsive plate includes a part located near a middle thereof and formed into a dish shape by drawing. The metal support has an end secured in the housing. The header plate assembly includes a header plate secured to the end of the open bottom, so that a pressure-proof closed container is formed by the header plate and the housing. The header plate has at least one through hole through which at least one conductive terminal pin is inserted and fixed in the hole by an electrically insulating filler. The header plate assembly further includes a fixed contact secured to the conductive terminal pin. The header plate assembly is hermetically secured to the housing assembly, so that switching contacts are formed by the movable contact and the fixed contact, and thereafter, a neighborhood of a part of the housing to which part the thermally responsive plate assembly is secured is deformed, whereby an operating temperature is calibratable. The pressure-proof closed container has a part secured to the metal support and provided with a calibrating part. Before the header plate assembly is hermetically secured to the housing assembly, the metal support of the thermally responsive plate assembly is deformed from an initial shape so that a position of the movable contact in the housing assembly is adjusted so as to be within a predetermined height range relative to the open end of the housing. As a result of the height adjustment, when the header plate assembly has hermetically been secured to the housing assembly, the movable contact is returned by a predetermined distance by contact with the fixed contact, so that a contact pressure between the switching contacts is produced. The calibrating part has a height falling within a predetermined range on a basis of an underside of the header plate.

According to the above-described thermal switch, the position of the movable contact in the housing assembly is adjusted before the header plate assembly is secured to the housing assembly, so that the specified contact pressure can be produced between the movable contact and the fixed contact when the header plate assembly is secured to the housing assembly. Accordingly, an amount of deformation of the calibrating part in the temperature calibration can be rendered smaller and substantially constant even when a curved shape of the thermally responsive plate after the drawing, the dimensions of the thermally responsive plate and the like vary from one product to another. This can avoid a reduction in the strength of the pressure-proof closed container due to deformation and conditions where the temperature calibration is impossible, and a stable protecting performance can be obtained after the temperature calibration.

BRIEF DESCRIPTION OF THE DRAWINGS

Various embodiments of the present invention will now be described in connection with the accompanying drawings, in which.

DETAILED DESCRIPTION OF EMBODIMENT(S) OF THE INVENTION

A first embodiment of the present invention will be described with reference to FIGS. 1 to 7.

Figure 1:
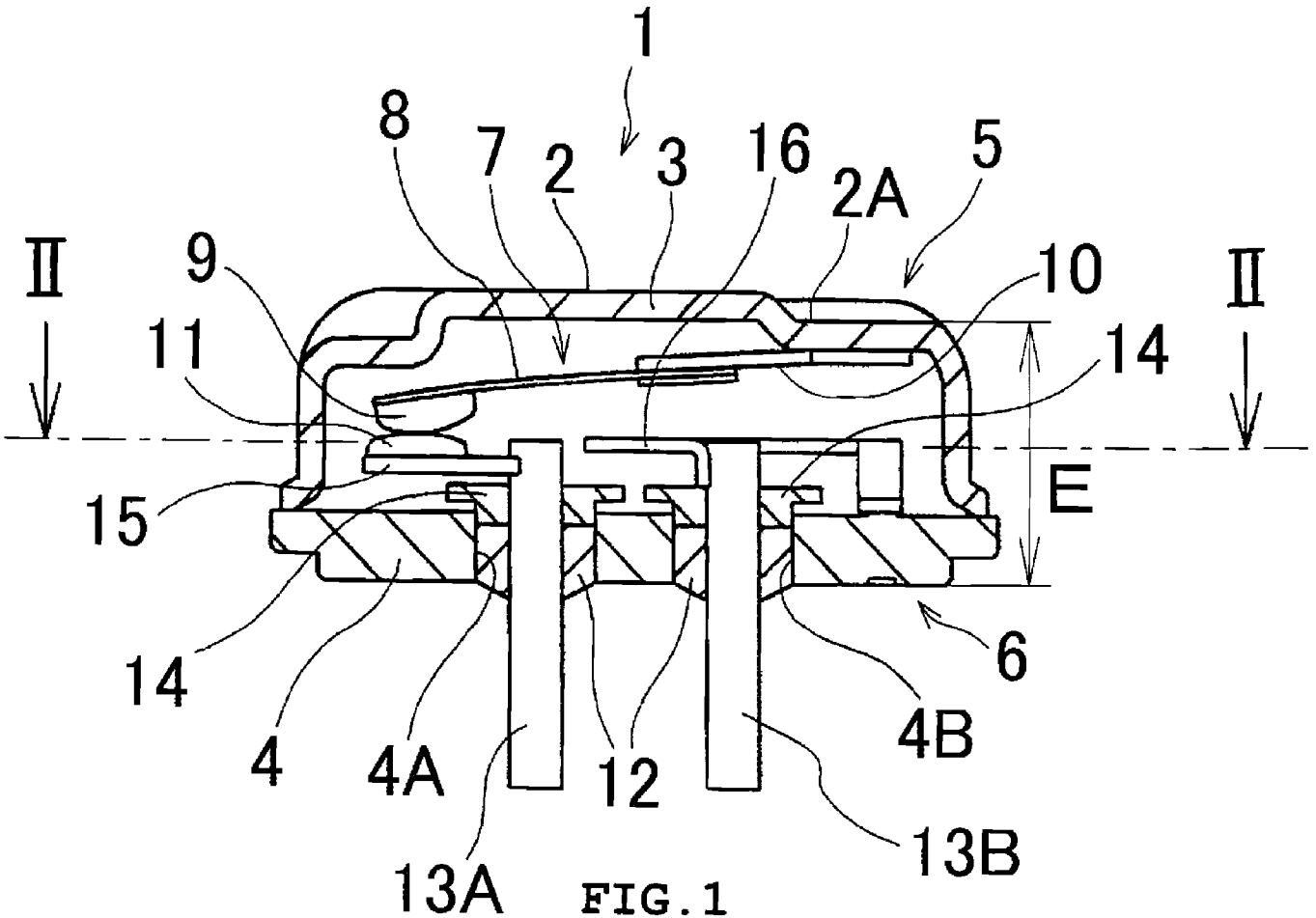
FIG. 1 is a longitudinal section of a thermal switch of a first embodiment in accordance with the present invention.
Figure 2:
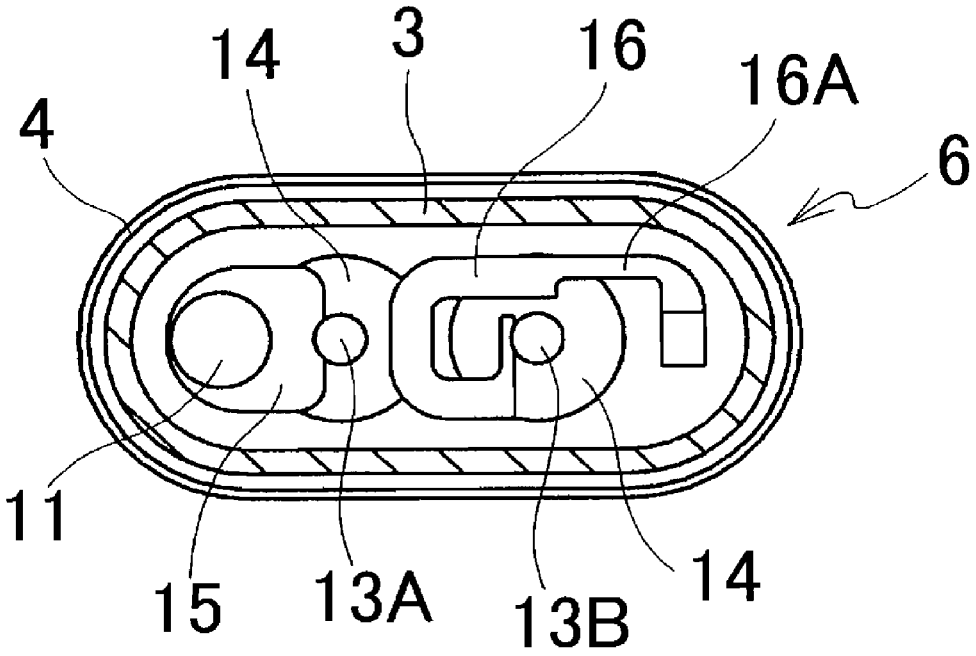
FIG. 2 is a cross section taken along line II-II in FIG. 1.
Figure 3:
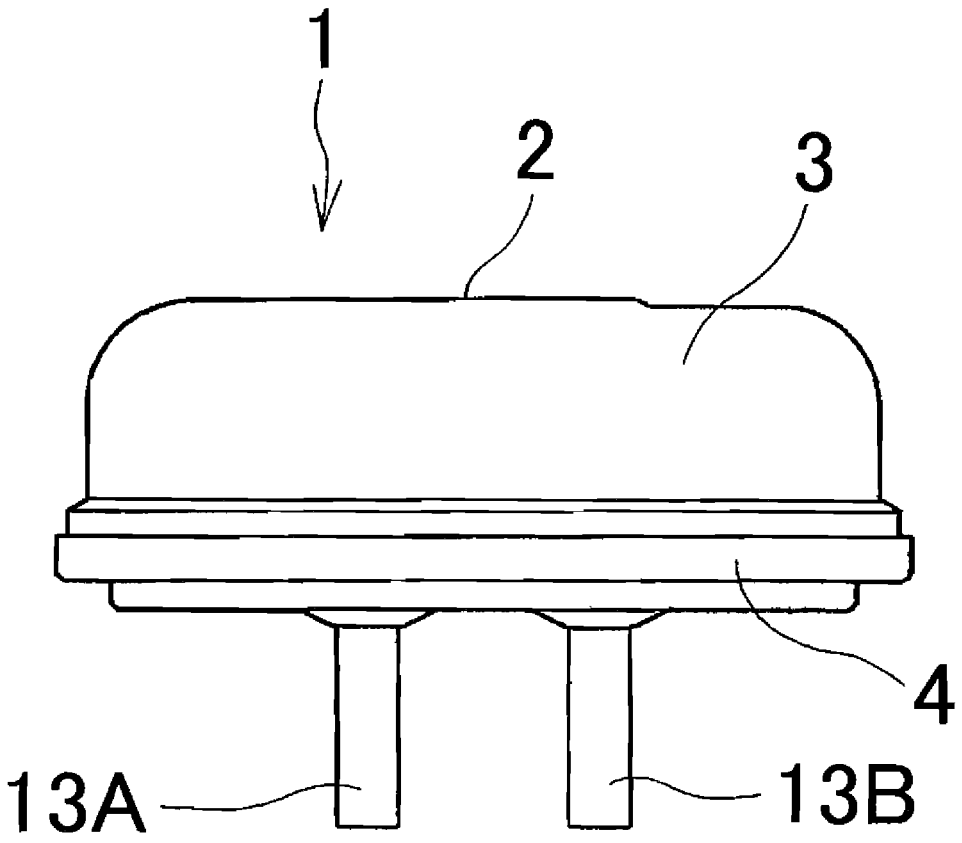
FIG. 3 is a side view of the thermal switch.
Figure 4:
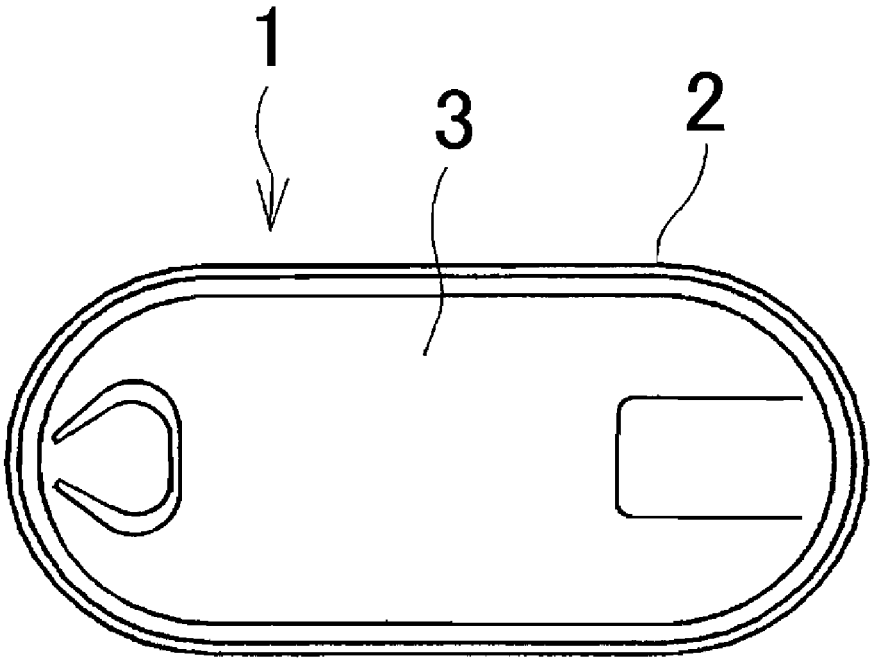
FIG. 4 is a plan view of the thermal switch.

FIGS. 3 and 4 are a side view and a plan view of a thermal switch respectively. FIG. 1 is a longitudinal section of the thermal switch and FIG. 2 is a transverse section taken along line II-II in FIG. 1. A thermal switch 1 includes a pressure-proof closed container 2 (hereinafter, "closed container 2") constructed of a metal housing 3 and a header plate 4. The housing 3 is formed into an elongate dome shape by drawing an iron plate or the like by a press machine so as to have both lengthwise ends each formed into a substantially spherical shape and a middle portion connecting the ends. The header plate 4 is formed by shaping an iron plate thicker than the housing 3 into an oval and is hermetically sealed to an open end of the housing 3 by the ring projection welding or the like.

The thermal switch 1 is constructed of a housing assembly 5 and a header plate assembly 6. The housing assembly 5 includes the housing 3 and a thermally responsive plate assembly 7 housed and fixed in the housing 3. The thermally responsive plate assembly 7 includes a thermally responsive plate 8, a movable contact 9 secured to one of two ends of the thermally responsive plate 8 by welding and a plate-shaped metal support 10 (hereinafter, "support 10") secured to the other end of the thermally responsive plate 8 by welding. The support 10 has an end which is opposed to its end secured to the thermally responsive plate 8 and is secured to an upper surface end in the housing 3 by welding.

The thermally responsive plate 8 is formed by drawing a thermally responsive member such as a bimetal or trimetal into a shallow dish shape and is configured to reverse a direction of curvature with a snap action when the thermally responsive plate 8 reaches a predetermined temperature. The closed container 2 includes a part (a calibrating part 2A) to which the support 10 is secured. A contact pressure between the movable contact 9 and a fixed contact 11 (as will be described later) is adjustable by externally crushing the part (the calibrating part 2A) of the closed container 2, so that a temperature at which the thermally responsive plate 8 reverses its curvature can be calibrated into a desirable specified value (crushing temperature adjustment).

Next, the header plate assembly 6 will be described. The header plate 4 is formed with through holes 4A and 4B. Electrically conductive terminal pins 13A and 13B are inserted through and hermetically fixed in the respective holes 4A and 4B by an electrically insulating filler 9 such as glass in view of a thermal expansion coefficient by a well-known hermetic compression sealing. Heat-resistant inorganic insulating members 14 each comprising ceramics and zirconia (zirconium oxide) are closely fixed to upper surfaces of the fillers 12 respectively. Each heat-resistant inorganic insulating member 14 is shaped in consideration of electrical strength against creeping discharge and physical strength such as heat resistance to sputtering. The heat-resistant inorganic insulating member 14 can improve a dielectric strength between the terminal pins 13A and 13B and the header plate 4 and prevent generated arc from transition to a space between the terminal pin 13B and the header plate 4 or a space between the terminal pins 13A and 13B.

A contact support 15 is secured to a part of the terminal pin 13A near the distal end of the pin inside the closed container 2. The fixed contact 11 is secured to a part of the contact support 15 opposed to the movable contact 9. A heater 16 serving as a heating element has two ends one of which is fixed to a portion of the terminal pin 13B located near the distal end of the terminal pin inside the closed container 2. The other end of the heater 16 is fixed to the header plate 4. The heater 16 is disposed so as to be substantially parallel to the thermally responsive plate 8 along the terminal pin 13B, so that heat generated by the heater 16 is efficiently transmitted to the thermally responsive plate 8, as shown in FIG. 2.

The heater 16 is provided with a fusing portion 16A (see FIG. 2) having a smaller sectional area than the other part thereof. The fusing portion 16A is prevented from being fused by an operating current of an electric motor during a normal operation of a compressor serving as equipment to be controlled. The fusing portion 16A is further prevented from being fused upon occurrence of a locked rotor condition of the motor since the thermally responsive plate 8 reverses the direction of curvature thereby to open the contacts 9 and 11 in a short period of time. However, when the thermal switch 1 repeats the opening and closure of the contacts 9 and 11 for a long period of time such that the number of times of switching exceeds a guaranteed number of switching operations, the movable and fixed contacts 9 and 11 are sometimes welded together thereby to be inseparable from each other. In this case, when a rotor of the motor is locked, a temperature of the fusing portion 16A is increased by an excessively large current, so that the fusing portion 16A is fused, whereupon power supply to the motor can reliably be cut off.

When current flowing into the motor is a normal operation current including a short-duration starting current, the contacts 9 and 11 of the thermally responsive switch 1 remain closed, so that the motor continues running. On the other hand, the thermally responsive plate 8 reverses the direction of curvature thereof to open the contacts 9 and 11 thereby to cut off the motor current when a current larger than a normal current flows continuously into the motor as the result of an increase in the load applied to the motor, when the motor is constrained such that an extremely large constraint current flows into the motor continuously for more than several seconds, or when the temperature of a refrigerant in the hermetic housing of the compressor becomes extremely high. Subsequently, when the internal temperature of the thermally responsive switch 1 drops, the thermally responsive plate 8 again reverses the direction of curvature thereof such that the contacts 9 and 11 are closed, whereupon energization to the motor is re-started.

The following will describe the height adjustment of the movable contact 9 in an assembly process and a process of calibrating a reversing temperature of the thermally responsive plate 8 after the assembling. The manufacture of the thermal switch 1 includes the assembly process and a calibration process. In the assembly process, the thermally responsive plate assembly 7 is made and mounted to the housing 3, so that the housing assembly 5 is manufactured. With this, the header plate assembly 6 is manufactured. Subsequently, the header plate assembly 6 is hermetically secured to the housing assembly 5 while the housing assembly 5 is filled with a gas at a predetermined pressure. In the subsequent calibration process, a calibrating part 2A of the container 2 is externally crushed in an oil which is kept at a specified reversing temperature, until the thermally responsive plate 8 reverses its curvature (the crushing temperature adjustment).

Variations in the curved shape of the thermally responsive plate 8 result from variations in the characteristics of the thermally responsive plate 8, processing variations due to drawing or the like, as described above. Further, variations resulting from welding or the like occur in the shape and dimensions of the thermally responsive plate 8 when the thermally responsive plate assembly 7 is made and when the thermally responsive plate assembly 7 is mounted to the housing 3. Still further, the shape of the support 10 slightly varies. When the crushing temperature adjustment is carried out in this state, an amount of deformation (an amount of crush) of the calibrating part 2A becomes excessively large with the result that the strength and durability of the closed container 2 are reduced, and the amount of crush varies for every product with the result that the ST operating time required until the opening of the contacts 9 and 11 varies.

In view of the problems, the support 10 mounted to the housing 3 in the assembly process is deformed from an initial shape so that an amount of crush in the crushing temperature adjustment becomes substantially constant and the amount of crush is reduced, whereby the position of the movable contact 9 is adjusted so as to be within a predetermined height range relative to the open end of the housing 3 even if the height of the movable contact 9 varies at the time of manufacture of the housing assembly 5. When the header plate assembly 6 is hermetically secured to the housing assembly 5, the movable contact 9 is pressed against the fixed contact 11 as the result of the height adjustment, so that a contact pressure (an initial contact pressure) is produced between the switching contacts.

Figure 5:
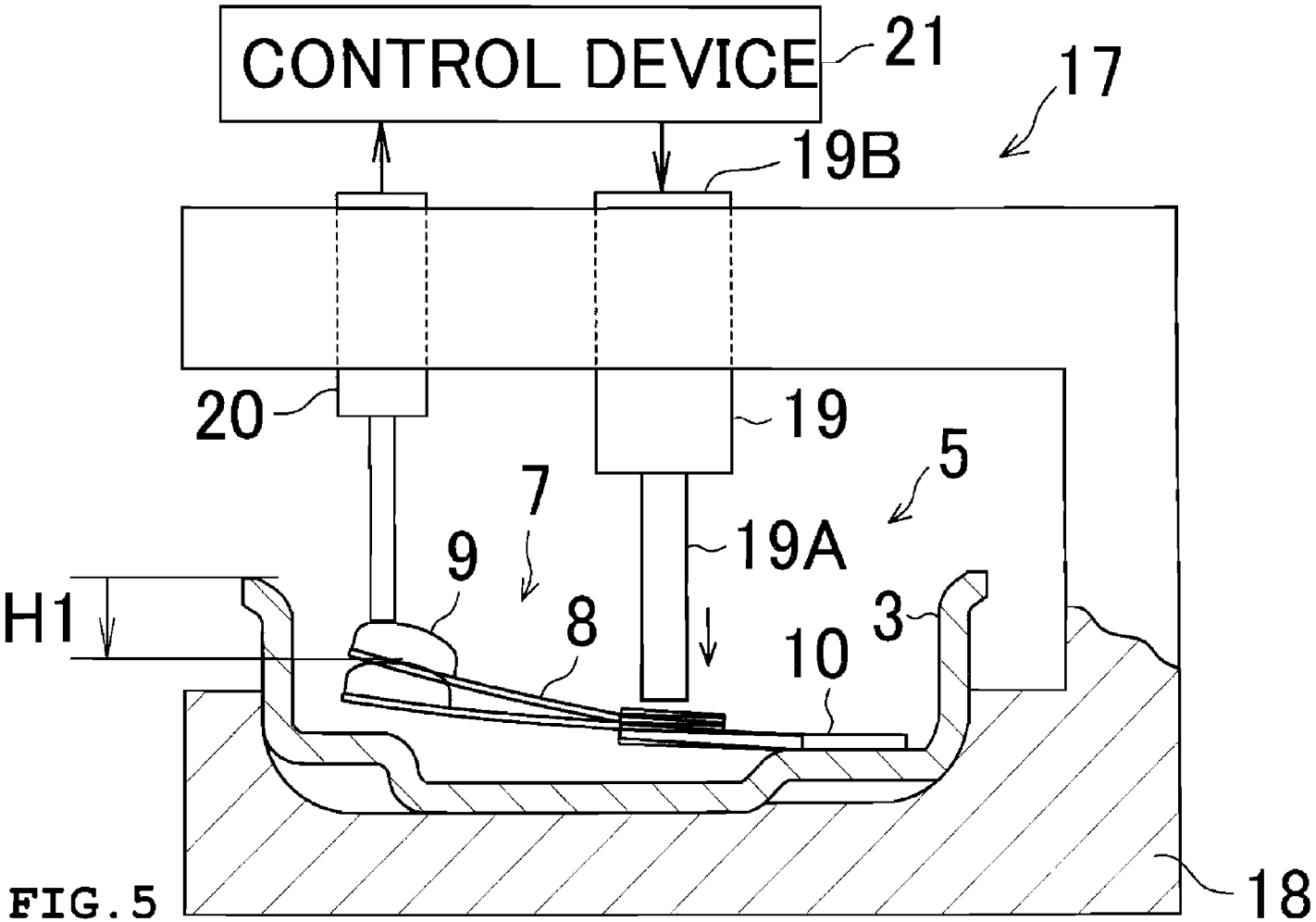
FIG. 5 is a configuration diagram showing a device for adjusting a height of the movable contact.

FIG. 5 shows the construction of a height adjuster 17 for adjusting the height of the movable contact 9. The height adjuster 17 includes a holding part 18, a pressing device 19, a position measuring device 20 and a control device 21. The holding part 18 holds the housing assembly 5 with the open end thereof up. The pressing device 19 includes a press cylinder having a servomotor or the like serving as a drive source and a rod 19A. In response to a command signal from the control device 21, the rod 19A is caused to thrust forward to press, from above, a neighborhood of a part of the support 10 in one direction, to which part the thermally responsive plate 8 is secured, namely, inward from the open end of the housing 3. The position measuring device 20 includes a differential transformer and measures a height H of the movable contact 9 from the open end in the housing assembly 5. The control device 21 controls the pressing device 19 so that the rod 19A is thrust downward until the value H measured by the position measuring device 20 equals a specified value H1, thereby deforming the support 10 from an initial shape.

Figure 6:
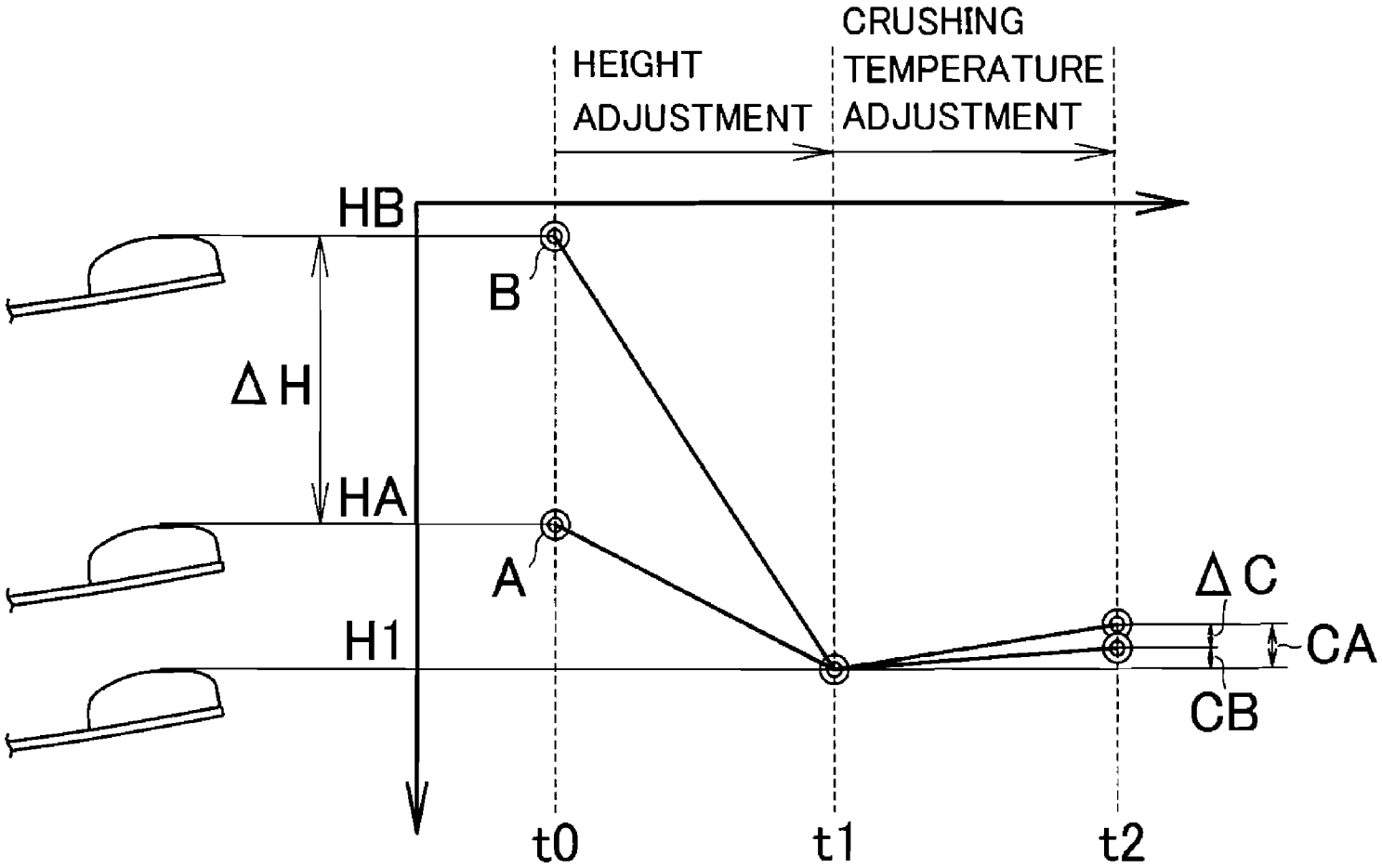
FIG. 6 is an explanatory illustration of the height adjustment and a crushing temperature adjustment.

FIG. 6 is an explanatory illustration of the height adjustment and a crushing temperature adjustment. Time t0 refers to the time when the thermally responsive plate assembly 7 is mounted to the housing 3. The vertical axis denotes the height of the movable contact 9 above the open end of the housing 3. An initial height H (a range from HA to HB) of the movable contact 9 is set to be smaller than the defined value H in every product though having variations within ΔH (0.5 mm, for example) as in the prior art (HA, HB<H1).

Time t1 refers to the time when the height adjustment of the movable contact 9 is completed by the height adjuster 17. The movable contact 9 is adjusted to be located at the position (within an acceptable error range) spaced away by the specified value H1 from the open end of the housing 3 in each one of all the products. The specified value H1 is set so that the contact with the fixed contact 11 returns the movable contact 9 by a predetermined distance when the header plate assembly 6 has been secured to the housing assembly 5 after time t1. The return results in a specific initial contact pressure between the movable contact 9 and the fixed contact 11.

Time t2 refers to the time when the crushing temperature adjustment is completed while the header plate assembly 6 is hermetically secured to the housing assembly 5. The vertical axis denotes a crush amount C with reference to the height position at time t1. Since the height adjustment of the movable contacts 9 has been carried out, the contact pressure at the time of assembly becomes substantially equal to one another among the products. Variations in the crush amount in the crushing temperature adjustment (ΔC=CA−CB) becomes extremely small, so that the crush amount can be prevented from differing to a large extent over all the products. Further, since the initial contact pressure is set beforehand, the crush amount can be rendered as small as possible in the crushing temperature adjustment.

Figure 7:
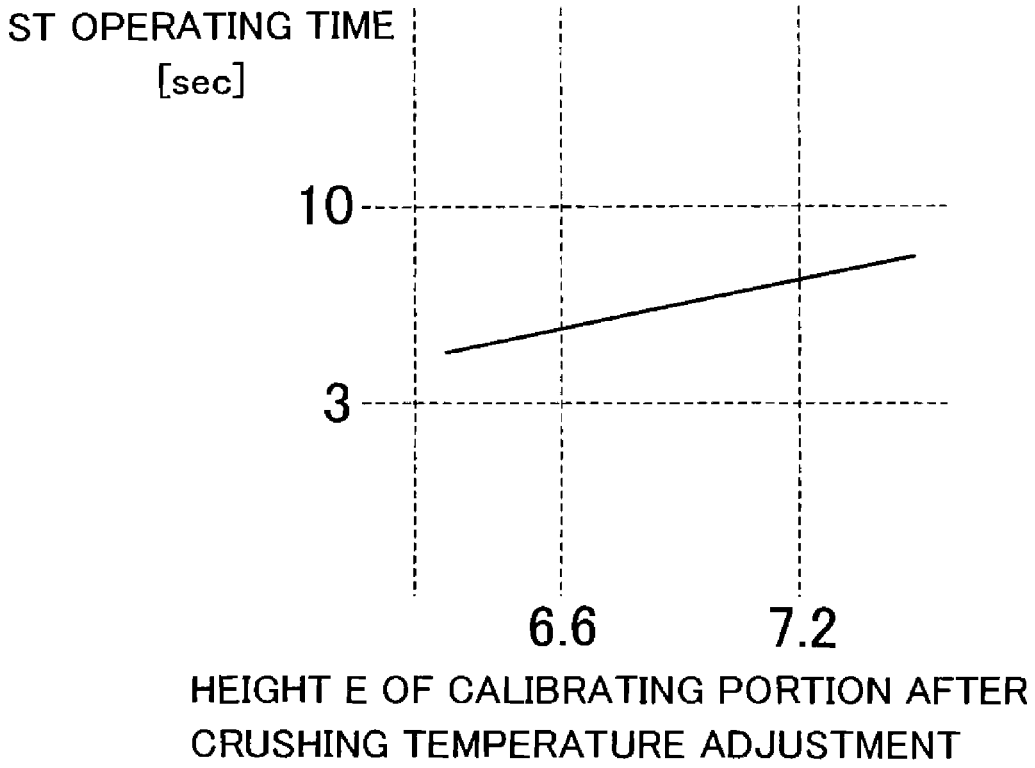
FIG. 7 is a graph showing the relationship between the height of the calibrating part after execution of the crushing temperature adjustment and the ST operating time.

FIG. 7 shows the relationship between the height E (see FIG. 2) of the calibrating part 2A after execution of the crushing temperature adjustment and the ST operating time required until the opening of the contacts 9 and 11 when an excessive current flows. When the crush amount is small and the height E of the calibrating part 2A with reference to an underside of the header plate 4 is high, the distance between the thermally responsive plate 8 and the heater 16 is increased with the result that the ST operating time is rendered longer. On the other hand, when the crush amount is large and the height E of the calibrating part 2A is low, the distance between the thermally responsive plate 8 and the heater 16 is reduced with the result that the ST operating time is rendered shorter. When the height adjustment of the movable contact 9 is performed prior to the crushing temperature adjustment, the height E of the calibrating part 2A after the crushing temperature adjustment falls within the range of 6.9±0.3 mm with the result that variations in the ST operating time can be reduced as compared with the prior art.

As described above, the thermal switch 1 of the embodiment is assembled through the process of deforming the support 10 of the thermally responsive plate assembly 7 mounted to the housing 3, from the initial shape. Accordingly, the position of the movable contact 9 in the housing assembly 5 is controlled to correspond to the predetermined height H1 relative to the open end of the housing 3, so that a crush amount in the crushing temperature adjustment can be rendered as small as possible. Consequently, the crush amount of the calibrating part 2A in the crushing temperature adjustment after the assembling can be rendered substantially constant, with the result that a stable motor protecting performance can be obtained while variations in the ST operating time among the products are reduced.

Further, the crush amount in the crushing temperature adjustment can be rendered as small as possible by setting the height H1 of the movable contact 9 in the crushing temperature adjustment so that a specific initial contact pressure is ensured between movable contact 9 and the fixed contact 11 after the assembling process. This can reduce strain applied to a neighborhood of the calibrating part 2A in the crushing temperature adjustment and can accordingly prevent reductions in the strength and durability of the closed container 2 disposed in the compressor interior which is a high-temperature and high-pressure environment.

The height of the movable contact 9 is adjusted after the support 10 of the thermally responsive plate assembly 7 has been welded to the housing 3. Accordingly, the height of the movable contact 9 can be adjusted in consideration of variations in the shape and the dimensions resulting from the welding of the support 10 to the housing 3 as well as the variations in the shape and the dimensions of the thermally responsive plate assembly 7. This can realize a constant crush amount with further accuracy in the crushing temperature adjustment.

The thermally responsive plate 8 is secured via the support 10 to the housing 3. The height of the movable contact 9 is adjusted by deforming the support 10. Since a bending angle of the support 10 made of a metal is changed, application of deformation to the thermally responsive plate 8 causes no variations in the reversing characteristics thereof, so that a stable motor protecting performance without variations can be obtained through a subsequent crushing temperature adjustment. Further, since the thermally responsive plate 8 is deformed by pressing it in one direction inward from the open end of the housing 3, the construction of the height adjuster 17 can be simplified.

Figure 8:
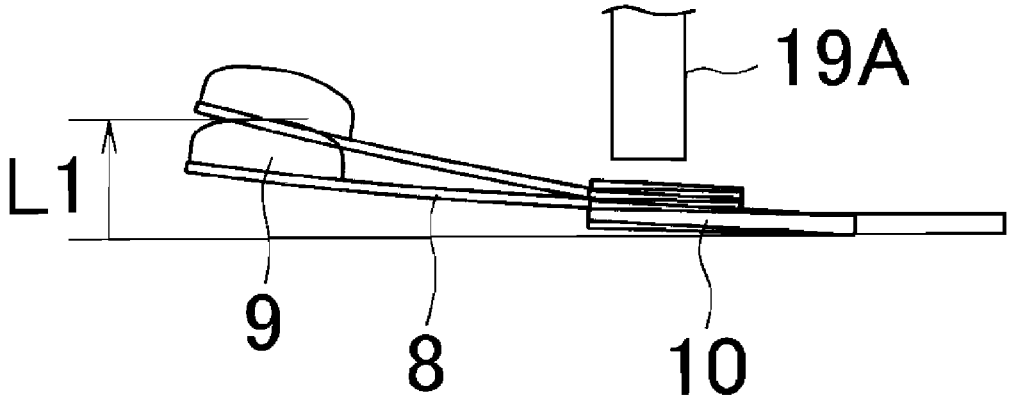
FIG. 8 is an explanatory illustration of a manner of adjusting the height of the movable contact, showing a second embodiment according to the invention.
Figure 9:
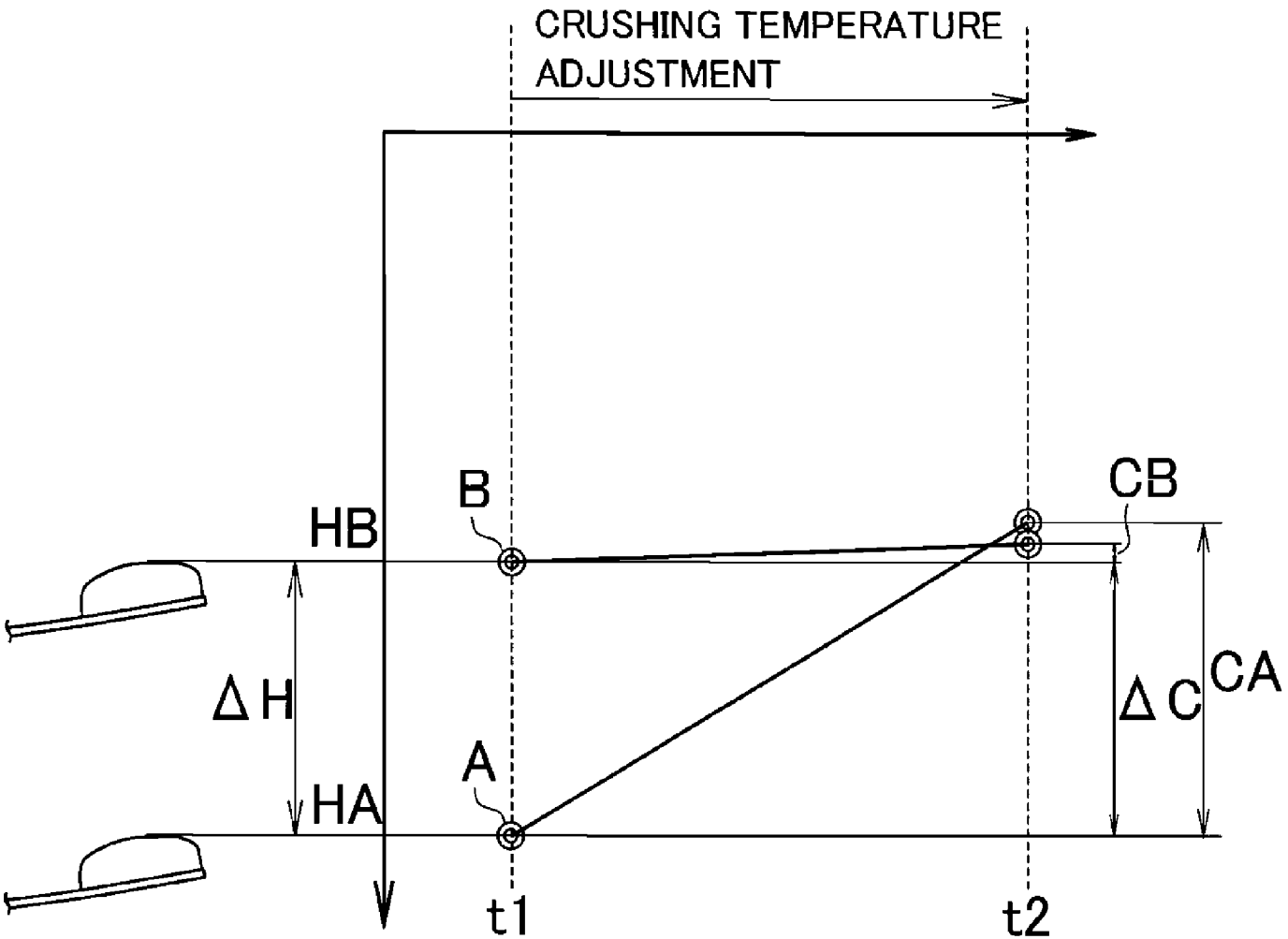
FIG. 9 RELATED ART
FIG. 9 is an explanatory illustration of a crushing temperature adjustment, showing a prior art.

A second embodiment of the invention will be described with reference to FIG. 8. In the embodiment, the height adjustment of the movable contact 9 is performed before the thermally responsive plate assembly 7 is mounted to the housing 3. FIG. 8 is an explanatory illustration of the height adjustment. The thermally responsive plate assembly 7 is disposed on the holding part, and the movable contact 9 is adjusted so as to be located at a predetermined height L1 with reference to the surface of the support 10 secured to the housing 3. The height adjustment is carried out by pressing a part of the support 10 secured to the thermally responsive plate 8, in one direction from above by the rod 19A of the pressing device 19. After the height adjustment, the thermally responsive plate assembly 7 is mounted to the housing 3, so that the housing assembly 5 is completed.

In this case, the position of the movable contact 9 in the housing assembly 5 is within the predetermined height range relative to the open end of the housing 3. The contact with the fixed contact 11 returns the movable contact 9 by a predetermined distance when the header plate assembly 6 is hermetically secured to the housing assembly 5. The return results in a specified initial contact pressure between the movable contact 9 and the fixed contact 11. In other words, the height L1 is set so that the specified initial contact pressure is generated.

In the second embodiment, the crush amount in the crushing temperature adjustment after the assembling is also rendered substantially constant and smaller by the same operation as in the first embodiment. In the second embodiment, dimensional variations caused by the welding of the support 10 and the housing 3 cannot be reduced by the above-described height adjustment. Accordingly, these dimensional variations are reduced by adjustment of the crush amount in subsequent crushing temperature adjustment.

The invention should not be limited to the foregoing embodiments. The embodiments may be modified as follows. The closed container 2 should not be limited to the elongate dome shape but may not be formed into the elongate dome shape when a certain strength is obtained by provision of ribs provided along the lengthwise direction of the container.

The support 10 is fixed to one end of the closed container 2. However, when the size of the thermal switch is further reduced, the support 10 may be fixed to a neighborhood of the central part of the closed container 2. The support 10 may be formed into a button shape.

The support 10 need not be formed into the plate shape.

The heater 16 and the heat-resistant inorganic insulating member 14 may be provided as the need arises.

Although two conductive terminal pins 13A and 13*b* are provided on the header plate 4, a single conductive terminal pin may be provided and the metal header plate 4 may serve as the other terminal.

Two or more pairs of the switching contacts each including the movable contact 9 and the fixed contact 11 may be provided. The electric motor with which the thermal switch is used should not be limited to the single-phase induction motor but may be another motor such as a three-phase induction motor.

As described above, the thermal switch of the invention is useful as a thermal protector for a compressor motor.

The invention claimed is:

1. A method of manufacturing a thermal switch which includes a housing assembly including a metal housing having an end with an open bottom and a thermally responsive plate assembly housed in the metal housing and including a thermally responsive plate, a movable contact secured to one of two ends of the thermally responsive plate, and a metal support secured to the other end of the thermally responsive plate, the thermally responsive plate including a part located near a middle thereof and formed into a dish shape by drawing, the metal support having an end secured in the housing; and a header plate assembly including a header plate secured to the end of the open bottom, so that a pressure-proof closed container is formed by the header plate and the housing, the header plate having at least one through hole through which at least one conductive terminal pin is inserted and fixed in the hole by an electrically insulating filler, the header plate assembly further including a fixed contact secured to the conductive terminal pin, the method comprising:

adjusting a position of the movable contact by deforming the metal support of the thermally responsive plate assembly from an initial shape, so that the position of the movable contact is within a predetermined height range relative to the end of the open bottom;

producing a contact pressure between the movable contact and the fixed contact after the height adjustment by hermetically securing the header plate assembly to the housing assembly with a result that the movable contact is returned by a predetermined distance by contact with the fixed contact; and calibrating an operating temperature after production of the contact pressure by deforming a neighborhood of a part of the housing to which part the thermally responsive plate assembly is secured.

2. The method according to claim 1, wherein the metal support of the thermally responsive plate assembly is secured to the housing so that the housing assembly is manufactured, and thereafter, the metal support is deformed from the initial shape with the housing assembly being in such a state that the metal support is secured to the housing.

3. The method according to claim 2, wherein a neighborhood of a part of the metal support to which part the thermally responsive plate is secured is pressed in a direction from the end of the open bottom toward an interior of the housing, whereby the height adjustment is carried out by deforming the metal support.

4. The method according to claim 1, wherein the height adjustment is carried out by deforming the metal support of the thermally responsive plate assembly from the initial shape before the metal support is secured to the housing.

5. The method according to claim 4, wherein the height adjustment is carried out by deforming the metal support so that a height of the movable contact relative to the part of thermally responsive plate assembly secured to the housing falls within a predetermined range.

6. The method according to claim 4, wherein the height adjustment is carried out by pressing a neighborhood of a part of the metal support to which part the thermally responsive plate is secured, in a direction, so that the metal support is deformed.

7. The method according to claim 5, wherein the height adjustment is carried out by pressing a neighborhood of a part of the metal support to which part the thermally responsive plate is secured, in a direction, so that the metal support is deformed.

8. A height adjuster adjusting a height of a movable contact of a thermal switch which includes a housing assembly including a metal housing having an end with open bottom and a thermally responsive plate assembly housed in the metal housing and including a thermally responsive plate, a movable contact secured to one of two ends of the thermally responsive plate, and a metal support secured to the other end of the thermally responsive plate, the thermally responsive plate including a part located near a middle thereof and formed into a dish shape by drawing, the metal support having an end secured in the housing; and a header plate assembly including a header plate secured to the end of the open bottom, so that a pressure-proof closed container is formed by the header plate and the housing, the header plate having at least one through hole through which at least one conductive terminal pin is inserted and fixed in the hole by an electrically insulating filler, the header plate assembly further including a fixed contact secured to the conductive terminal pin, wherein the pressure-proof closed container includes a calibrating part to which the metal support is secured, and a height of the calibrating part with reference to an underside of the header plate falls within a predetermined range, the height adjuster comprising:

a holding part holding the housing assembly;

a pressing device pressing the metal support of the housing assembly held by the holding part thereby to deform the metal support from an initial shape;

a position measuring device measuring a position of the movable contact in the housing assembly; and a control device controlling the pressing of the pressing device so that the position of the movable contact measured by the position measuring device is within a predetermined height range relative to the end of the open bottom, wherein the pressing device causes a rod to press a neighborhood of a part of the metal support to which part of the thermally responsive plate is secured.

9. The height adjuster according to claim 8, wherein the metal support is deformed from the initial shape after being secured to the housing.

10. The height adjuster according to claim 9, wherein the metal support is deformed when the neighborhood of the part is pressed in a direction from the end of the open bottom toward an interior of the housing.

11. The height adjuster according to claim 10, wherein, when the metal support is deformed, a height of the movable contact relative to the part of thermally responsive plate assembly secured to the housing falls within a predetermined range.

* * * * *